US005259200A

United States Patent [19]

Kamody

[11] Patent Number: 5,259,200

[45] Date of Patent: Nov. 9, 1993

[54] PROCESS FOR THE CRYOGENIC TREATMENT OF METAL CONTAINING MATERIALS

[75] Inventor: Dennis J. Kamody, Pittsburgh, Pa.

[73] Assignee: Nu-Bit, Inc., New Kensington, Pa.

[21] Appl. No.: 753,162

[22] Filed: Aug. 30, 1991

[51] Int. Cl.[5] ..... F25D 13/06; C21D 9/18

[52] U.S. Cl. ..... 62/64; 62/62; 62/65; 148/577; 148/578; 148/905

[58] Field of Search ..... 62/62, 64, 65; 148/232, 148/577, 578, 587, 905

[56] References Cited

U.S. PATENT DOCUMENTS

| | | | |
|---|---|---|---|
| 2,197,365 | 4/1940 | Kjerrman | 148/578 |
| 2,598,760 | 6/1952 | Cobb . | |
| 2,949,392 | 8/1960 | Willey . | |
| 3,173,813 | 3/1965 | Dewey et al. . | |
| 3,185,600 | 5/1965 | Dullberg | 148/577 |
| 3,891,477 | 6/1975 | Lance et al. | 62/64 X |
| 4,482,005 | 11/1984 | Voorhees . | |

FOREIGN PATENT DOCUMENTS

| | | | |
|---|---|---|---|
| 59-24751540 | 8/1984 | Japan . | |
| 7802562 | 9/1978 | Netherlands | 148/577 |
| 492563 | 3/1975 | U.S.S.R. . | |
| 1252364 | 8/1986 | U.S.S.R. . | |
| 746028 | 3/1956 | United Kingdom | 148/577 |
| 1353753 | 5/1974 | United Kingdom . | |

OTHER PUBLICATIONS

Wilson, R. A., "Industry Warms Up to Supercold", Iron Age, Aug. 26, 1971 pp. 55-56.

*Primary Examiner*—Henry A. Bennet
*Assistant Examiner*—Christopher Kilner
*Attorney, Agent, or Firm*—Armstrong, Westerman, Hattori, McLeland & Naughton

[57] ABSTRACT

A process for treating an article of metal containing material such as tool steel so as to improve the properties such as shockability, wearability, stability and hardness of the article. In one embodiment, the process comprises immersing the article at ambient temperature into liquid cryogenic material for a time period up to or equal to a set time period equal to the minimum cross-sectional dimension in inches times ten minutes. The article is then withdrawn from contact with the liquid cryogenic material and immediately subjected to a flow of air sufficient to raise the temperature of the article to ambient temperature in a period of time equal to or less than ten minutes plus ten minutes per minimum cross-sectional dimension in inches.

18 Claims, 1 Drawing Sheet

PROCESS FOR THE CRYOGENIC TREATMENT OF METAL CONTAINING MATERIALS

The present invention relates generally to processes for treating metal containing materials such as steels, and more particularly, to cryogenic type treatment processes for improving or enhancing properties such as shockability, wearability, stability and hardness of metal containing materials where, in the processes, specific temperature regulation steps are utilized to treat the materials at cryogenic temperatures and then to immediately heat the materials back to ambient temperature after treatment at cryogenic temperature so as to provide an accelerated treatment.

While the processes of the subject invention will be discussed primarily hereinafter with reference to processes for improving the properties of steel type materials using liquid nitrogen as the cryogenic material, it is to be understood that the use and the application of the processes of the subject invention are not thereby so limited. For example, the processes of the invention may be useful in the treatment of many other metal containing materials not including iron although their use in connection with iron containing materials is presently preferred. It addition, other cryogenic media may be utilized in the process such as other liquified or solidified gases.

In the manufacture of tools and tool components, machinery, engine parts, wear surfaces and the like articles from various steels which are used for high wear applications, it is common practice to subject the steel to one or more treatments, either before or after formation of the steel carbide, so as to modify the properties of at least the exterior of the component and thereby provide the articles with a longer wear life and the like. A number of thermal type processes are known in the metallurgical arts to enhance the properties of metal containing materials such as steels. One widely used class of such metallurgical processes generally involve a heat treatment of the metal containing article, that is, elevating the temperature from ambient or from forming temperatures and then cooling. Another common class of enhancement processes is sometimes known as quenching and typically involves forming an article of the desired metal containing material and then rapidly lowering the temperature of the article followed by a return of the article to ambient temperature. A combination of the two classes of treatment processes is often used.

In either type or class of enhancement processes, the general intent is to modify or alter the microstructure of the metal containing material and/or to relieve stress or other physical conditions in the material. In the case of steel type materials, transformation of the material from an austenitic state or condition to the martensitic state is the desired result. Generally, it has been found that a heat type treatment for modifying a metal containing material results in less than 100% of the material being transformed from the austenitic to the martensitic state, a transformation typically on the order of only 85% to 95%. Even with a heat treatment using the utmost care and the best available treatment equipment, transformations in excess of 95% are very difficult to achieve. As a consequence, heat treated articles are oftentimes further subjected to a quenching type treatment so as to maximize the transformation of the steel from one state to another.

A quenching type treatment may involve the reduction in temperature from an elevated temperature (a temperature significantly above room temperature) to ambient temperature or below or may involve the reduction of temperature of the article from room temperature or both. The change in temperature may be accomplished quickly or slowly or combinations thereof in modifying the condition of the article from one temperature to another.

For example, a typical cryogenic quenching process of the metallurgical type used in the manufacture of tool steel articles includes a relatively slow reduction in temperature from room temperature to an intermediate or conditioning temperature well below 0° F. such as −100° F. and then a rapid reduction in temperature of the tool steel article by immersing the article in a bath of liquid nitrogen. Generally the article is immersed in the bath for a period of time generally equal to or greater than one hour per inch in cross section. Typically, the article is gradually cooled to the intermediate temperature by suspending the article directly over the bath of liquid nitrogen and in close proximity to the surface of the liquid nitrogen.

According to conventional procedures, after the article has been immersed in the bath for the requisite time period as noted above, the article is removed from direct contact with the liquid nitrogen and but is suspended over the bath of liquid nitrogen or otherwise kept in close proximity to the bath such that the article only slowly and gradually increases in temperature. It is the general practice to allow the article to increase in temperature in this fashion until the temperature again reaches the intermediate temperature. Thereafter, the article is moved away from the liquid nitrogen or otherwise separated therefrom and is allowed to return to room temperature by contact with still or quiet ambient air.

An example of the process described above is shown schematically in sequential form by FIGS. 1*a* through 1*d*. More specifically, in the illustrated process, an article 10 of tool steel to be treated by the process which is initially at room temperature of about 70° F. is lowered over open container 12 containing a bath 14 of liquid nitrogen as is illustrated in FIG. 1*a*. The article 10 is maintained in this position over the nitrogen bath until its temperature reaches about −100° F. throughout. The generally accepted practice in the metallurgical arts is to allow a minimum of about one hour per inch cross section of the article to reach this intermediate temperature. Thereafter, as is shown in FIG. 1*b*, article 10 is lowered into bath 14 of liquid nitrogen so as to cool the article to a cryogenic temperature approximately the temperature of the liquid nitrogen, that is, about −327° F. Like the first step of this procedure, the generally accepted practice is to treat the article for a minimum of about one hour per inch cross-section of the article at the cryogenic temperature provided by the liquid nitrogen.

After treatment in bath 14 of the liquid nitrogen, article 10 is elevated out of the bath and again suspended over the upper surface of the liquid nitrogen and allowed to remain in that position so as to slowly reach the intermediate temperature of about −100° F. as is illustrated in FIG. 1*c*. Again, a minimum of about one hour per inch of cross-section of the article is generally allowed for this step of the process. The article 10 is then removed from close proximity to bath 14 and allowed to heat up to room temperature by contact with still ambient air. This latter step is shown in FIG. 1*d*. The time period generally utilized for this step is on the order of a minimum of about one hour per inch of minimum cross-section of the article being treated.

As is apparent from the above description, the time period necessary to complete each step in the cycle of the treatment process generally is a minimum of about an hour per cross-section inch of the article being treated. Thus, for example, treatment of a steel article having a one inch cross-section in the minimum dimension would require a minimum of four hours total to complete the treatment according to generally accepted practices. In a like fashion, an article having a three inch minimum cross-section dimension would require a minimum of twelve hours total to complete the treatment according to the same accepted practices. However, it has been fairly conventional to increase the time periods for each step of the process to ensure that treatment is complete. Thus, for example, many of those practicing the above process routinely provide a safety factor of two or three or more in determining the respective time periods for the steps and as a consequence, overall treatment time periods of up to 50 hours or more for an article having a cross-sectional minimum dimension of one inch are often used. In using such extended time periods for the cryogenic treatment, it is believed that possible stress cracking and distortion of the article are thereby minimized or even eliminated.

While the treatment metal containing materials such as steels with the above described quenching procedure produces articles of desirable and enhanced characteristics, the costs associated with such treatment tend to be high per article. A significant factor affecting the relatively high added costs is the equipment costs in providing and handling cryogenic fluids such as liquid nitrogen and which is compounded by the relatively long treatment times required to produce articles having the desired degree of enhanced properties, particularly for steels in essentially transforming the steel from one state to another. The relatively high costs of cryogenic type quenching processes for use in metallurgical applications have tended to be a negative factor in implementation of such processes by both product manufacturers and the metal treating industry.

Generally, the commercial economics of metalurgical procedures dictate that a particular treatment should be accomplished as quickly as possible so as to minimize the size of the equipment necessary and thus equipment costs as well as requiring less space, energy and inventory in processing. Furthermore, the cryogenic fluid such as liquid nitrogen is of course continually lost during treatment and thus its use should be minimized per article to minimize production costs.

SUMMARY OF THE INVENTION

It is therefore a feature of the subject invention to provide a process for the cryogenic treatment of articles of metal containing material which can be conducted in significantly less time than conventional cryogenic processes and thus increases productivity by reducing work-in-progress time during manufacturing of an article.

It is also a feature of the subject invention to provide a process for the cryogenic treatment of articles of metal containing material which is conducted using an accelerated cooling and reheating or thawing time periods in the cryogenic treatment cycle.

It is another feature of the present invention to provide a process for the cryogenic treatment of articles of metal containing material which can be conducted at significantly less cost than conventional cryogenic processes.

It is a further feature of the subject invention to provide a process for the cryogenic treatment of articles of metal containing material, particularly iron containing material, which produces articles having, among other things, improved properties such as enhanced shockability, wearability, stability and hardness and thus increased life for the articles.

It is yet another feature of the subject invention to provide a process for the treatment of metal containing materials that is particularly adapted for the treatment of tool steels so as to provide articles of such tool steels with improved stability, shockability and hardness and extended wearability.

Briefly, the present invention comprehends in its broader aspects a process for treating an article of metal containing material, the process comprising contacting the article at ambient temperature or below with a cryogenic material for a time period up to or equal to about ten minutes, withdrawing the article from contact with the cryogenic material, and immediately subjecting the article to a flow of gaseous fluid sufficient to raise the temperature of the article an average of at least about one degree F. per minute until the article reaches ambient temperature.

The subject invention further comprehends a preferred process for treating a tool steep article having a minimum cross-sectional dimension, the process comprising immersing the article at ambient temperature into liquid cryogenic material for a time period up to or equal to about ten minutes, withdrawing the article from contact with the liquid cryogenic material, and immediately subjecting the article to a flow of air sufficient to raise the temperature of the article to ambient temperature in a period of time equal to or less than ten minutes plus ten minutes per minimum cross-sectional dimension in inches.

Further features, objects and advantages of the present invention will become more fully apparent form a detailed consideration of the arrangement of the steps and conditions of the subject processes as set forth in the following description when taken together with the accompanying drawings.

DETAILED DESCRIPTION OF THE INVENTION

As was previously mentioned, the subject invention is directed in one of its aspects to a process for the cryogenic treatment of metal containing material. For the purposes of illustration only, the subject process is described hereinafter with reference to a particularly preferred process for the treatment of article of tool steel in a bath of liquid nitrogen so as to, among other things, improve the shockability, wearability, stability and hardness of at least the surface of the article.

Figure 1A:
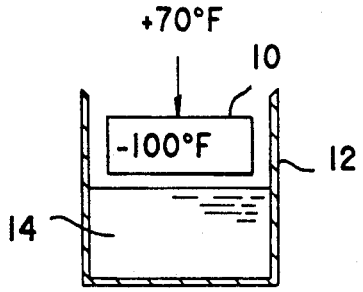
Fig.1a (PRIOR ART)
FIGS. 1*a* through 1*d* form a simplified process diagram for a known cryogenic quenching type metallurgical treatment process for steel articles, and FIGS. 2*a* and 2*b* form a simplified flow diagram illustrating one embodiment of a process according to the present invention.
Figure 1B:
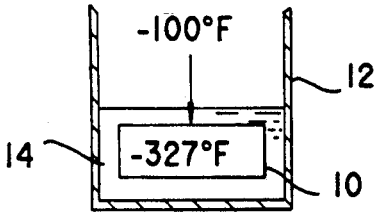
Fig.1b (PRIOR ART)
Figure 1C:
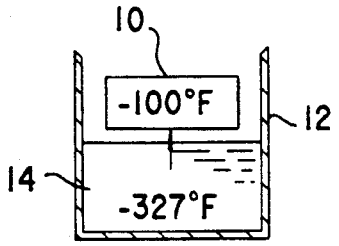
Fig.1c (PRIOR ART)
Figure 1D:
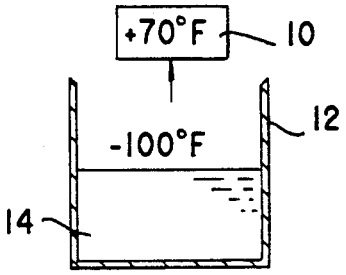
Fig.1d (PRIOR ART)
Figure 2A:
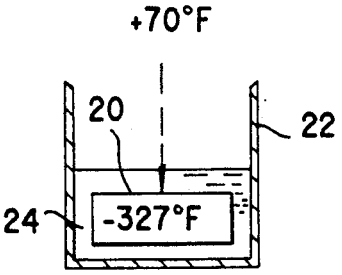
Figure 2B:
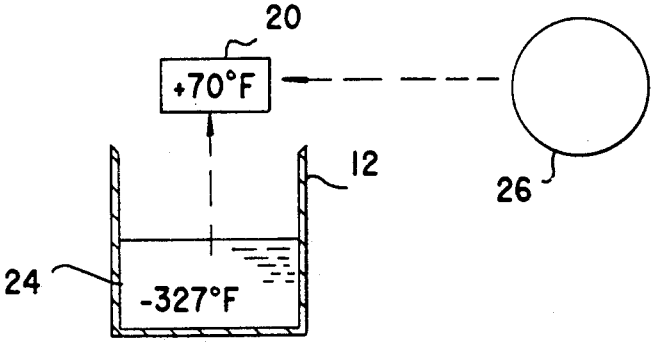

A particularly preferred process as illustrated by the process sequence diagrams of FIGS. 2*a* and 2*b* of the drawings. More specifically, in the process step shown in FIG. 2*a*, article 20 of steel to be treated by the process of the subject invention is initially at room temperature, generally about 70° F. Article 20 is then directly lowered or immersed in bath 24 of cryogenic fluid such as liquid nitrogen in container 22 so as to cool the article to a temperature approaching the temperature of the cryogenic fluid, for example to about −327° F. when the cryogenic fluid is liquid nitrogen.

The article 20 is allowed to remain in the cryogenic fluid only for period of time sufficient to for the cryogenic fluid to stop boiling or set period of time, whichever occurs first. For most if not all articles, particularly those having a relatively small minimum dimension, e.g., less than about twelve inches, this latter set time period is about ten minutes. Thus, for example, a tool steel article having a minimum cross-sectional dimension of about four inches, the maximum time for treatment of the article in the bath of cryogenic fluid would be about ten minutes.

After treatment in bath 24 of cryogenic fluid, article 20 is removed from the bath and separated from any influence from the cryogenic fluid in terms of temperature regulation. Generally, this involves physically separating the article from the bath by a sufficient distance that the temperature of the bath no longer appreciably affects the temperature of the article. Once separated from bath 24, article 20 is immediately subjected to a flow of ambient air created by fan 26 so as to raise the temperature of the article to that approximating ambient or room temperature.

Conditions for operating the subject process may vary considerably as indicated above depending upon, among other things, the particular material of the article being treated, desired properties of the material depending upon its intended use, the degree to which the material is to be treated, and the particular composition of the cryogenic material being utilized which governs its cryogenic temperature.

The required rate of air flow in conducting this latter step in the process may very considerably depending upon, among other things, the temperature of the article upon emergence form the bath, the type of material which forms the article, the mass and shape of the article, and the temperature and conditions, e.g.. humidity, of the air. Some of the general considerations in determining the optimum flow rate involve balancing the most rapid increase in temperature for the article to minimize the time required to treat the article with the energy costs and equipment costs associated with the generation of the air flow.

Generally speaking, the flow of air should be sufficient to, on average over the temperature range, increase the temperature of the article by at least one degree F. per minute, preferably at least about five degrees F. per minute and more preferably at least about ten degree per minute such as about twenty degrees per minute on average. Obviously, the rate of temperature increase will be the greatest upon emergence of the article from the bath and gradually decrease as the temperature of the article approaches the temperature of the flowing air presuming a constant flow of air. As a general rule, the greater the minimum cross-sectional dimension, the greater the time period should be used for returning the article to ambient temperature. For many materials such as steels and particularly tool steels, the flow of air should be sufficient that the temperature of the article reaches ambient over a maximum time period equal to 10 minutes minimum plus and additional 10 minutes per minimum dimension in inches or portion thereof.

However, on the other hand, the rate of temperature rise in the article in the second step should be limited so as to prevent damage to the article which may occur due to, among other things, thermal stresses resulting in cracking, distortion and deformation, caused by a too rapid increase in temperature of the article. Those of ordinary skill in the art to which the present invention pertains will be able to easily determine an appropriate air flow rate from the above criteria.

In the course of elevating the temperature of the article from the cryogenic temperature, the flow of air tends to quickly remove condensation products such as frost, water droplets and the like which may form on the article upon its emergence from the bath of cryogenic material. As a consequence, any adverse effects which may be caused by a reaction between the condensate and the article such as oxidation are thereby minimized.

While the air of the air flow used in elevating the temperature of the article removed from contact with the cryogenic material preferably is of flow of air at ambient temperature created by mechanical means such as a fan or the like for cost considerations, air from other sources can be used as well. For example, air from a compressed air source, ventilation equipment and the like having the appropriate temperature can be used so long as air does not adversely affect the treated article such as by containing contaminants and the like.

In addition, the process described above with reference to FIG. 2 uses a flow of ambient air to raise the temperature of the article after removal from the bath of cryogenic material, flows of other gases could be used with generally equal effect. For example, the gaseous medium could an inert gas such as nitrogen, a flue gas, a waste gas or the like. If another gaseous medium is used other than air, the gas is preferably at ambient temperature for the considerations mentioned below. Alternatively, other generally inert gaseous media may also be incorporated into the flow of air to elevate the temperature of the article being treated from the cryogenic temperature.

In some situations, the use of air or other gaseous media having a temperature slightly above ambient may be advantageous in more rapidly elevating the temperature of the article to ambient temperature. If however, the article is to be immediately handled after being elevated in temperature by heated air, the use of heated air may be disadvantageous since the article must then be allowed to cool or alternatively the article monitored for temperature.

An important consideration in conducting the step of the process of elevating the temperature of the article from at or near the temperature of the cryogenic material is that the use of a flow of air having a temperature elevated from ambient may modify the structure of the article, particularly the metallurgical structure of a metal containing material, which can adversely affect the properties of the article. For example, in elevation of the temperature of a metal containing material such as steel, the use of a flow of heated air can alter metallurgical structures such that properties such as the hardness of the material are adversely affected and the ability of the material to securely cement newly formed martensitic crystal structures into the material is impaired.

Consequently, in the treatment of many metal containing materials, particularly steel materials, according to the process of the present invention, the use of a flow of heated air, that is, air at an elevated temperature of significantly above ambient such as such as 100° F. or more, should be avoided. However, once the treated article reaches ambient temperature and thus all condensation products have been removed by the flow of air, the article can be subsequently treated by various heat treatments and/or other treatments according to standard metallurgical procedures so as relieve stresses and the like.

As is apparent from the above description, the time period necessary to complete a cycle of the treatment process according to the invention generally is a maximum of about one quarter hour per cross section inch of the article being treated. Thus, for example, treatment of a steel article having a two inch cross-section in the minimum dimension would only require a period of about one half hour total to complete the treatment according to the invention. In a like fashion, an article having a three inch minimum cross-sectional dimension would require a maximum of about forty minutes to complete the treatment according to the present invention. Contrary to generally accepted beliefs in the metallurgical arts, in so doing, stress cracking and distortion do not tend to occur even with the relatively short time periods used in the subject treatment processes.

In a particularly preferred embodiment of the process of the present invention, article 20, after reaching room temperature as is illustrated in FIG. 2*b*, is subjected to a treatment at an elevated temperature, that is a temperature significantly above room temperature such as 100° F., preferably 200° F. or more, generally about at a temperature of about 250° to 500° F., depending upon the type of material being treated. For tool steel type materials, a heat treatment at a temperature of about 400° to 500° F. such as 450° F. is presently preferred in order to, among other things, relieve stresses. The time period for this heat treatment step may vary considerably but generally the period of time utilized will be sufficient to maximize the desired properties of the material, generally a period of one hour or more such as from two to four hours.

Generally speaking, the metal containing material which can be advantageously treated by the processes of the present invention may vary considerably and can include metallic elements, metal alloys and metal composites either alone or in combination with non-metallic materials such as ceramics, polymeric materials and the like. Suitable metals included in the metal containing materials include iron, nickel, cobalt, copper, aluminum, refractory metals such as tungsten, molybdenum and titanium, combinations, alloys and composites thereof including carbide, nitride and boride containing materials and the like.

The process of the invention has been found to be particularly advantageous for the treatment of iron containing materials including cast iron, iron alloys, iron containing composites as well as for various steels. In the latter regard, various properties of steels such as tool steels used for forming, shaping or cutting materials such as metals, metallic composites, organic materials such as polymers and especially reinforced polymers, have been found to benefit from the process of the present invention, particularly with regard to their shockability, hardness and/or resistance to wear. Such tool steels are oftentimes fabricated into tools such as drill bits, taps, cutting blades, reamers, borers, dies and the like. For example, it has been found that drill bits of tool steel treated according to the process of the present invention may have increased life of at least two up to fifty times or more as compared with similar drill bits not having been treated according to the process of the invention.

The process of the invention has also been found to be particularly advantageous for the treatment of materials known a cemented carbides such as those containing tungsten carbide. Certain classes of cemented carbides such as those known under the designations C1, C5 and C6 containing nickel and cobalt especially benefit in terms of improved shockability, wearability, stability and hardness by treatment at cryogenic temperatures, in particular by the treatment of the process of the present invention when utilizing liquid nitrogen.

The cryogenic material used in the subject process to lower the temperature of the article being treated to a cryogenic temperature can be selected from a variety of materials, the primary considerations in the selection being the temperature of the material and its availability and thus cost, and ease and safety in handling. Generally cryogenic fluids such as liquified gases including liquid nitrogen and liquid oxygen are preferred for use as the cryogenic material. Other commercially significant cryogenic materials include liquified argon, helium and hydrogen. Liquid nitrogen is presently preferred due to its wide availability and low cost as well as its ease and safety in handling and favorable temperature (about −327° F.). Solid cryogenic materials such as solidified carbon dioxide (dry ice) may be employed as the cryogenic material because of low costs and minimal safety hazards associated with its use. However dry ice does have the disadvantage that solid-solid heat transfer between the cryogenic material and the article being treated may not be as efficient as liquid-solid transfer due to limited surface contact.

Container 12 may be of various constructions and designs of the type which are adapted to hold a bath of cryogenic material. Generally such containers are highly insulated and are constructed of materials which are non-reactive with the cryogenic material.

Of particular significance to the processes of the subject invention as described above are the provisions of quickly lowering the article to be treated to cryogenic temperature, holding the article for only a relatively short period of time at that temperature and then quickly raising the article back to ambient temperature with the air of flowing air or other gaseous media. As is apparent, such processes require only a minimal amount of time to conduct thus significantly reducing processing costs for the articles while yielding completed articles which have significantly improved properties, particularly with respect to shockability, hardness, stability and/or wearability. Further of significance is that the processes require no specialized equipment or burdensome procedures as compared to conventional cryogenic processes. Thus the subject invention specifically recognizes and uses to advantage, among other things, the beneficial effects of cryogenic procedures with the minimum of cost in both equipment, materials and processing time.

As used herein, the term "cryogenic temperature" generally refers to a temperature below about −100° F., generally below about −150° F., and typically on the order of about −200° F. or below, preferably below about −300° F. The term "ambient temperature" generally refers to a temperature of the external air about article to be treated and can vary from about 0° F. to about 100° F. and includes room temperature. The term is intended to encompass those normal temperatures encountered by an article of metal containing material during processing in a manufacturing facility and thus can include temperatures corresponding to the external environment, e.g., the outside environment, in which the articles typically may be processed or stored. The term "room temperature" generally refers to the temperature at which buildings and the like are maintained for human habitation and typically is about 70° F. The phrase "minimum dimension" as applied to a three dimensional article means the smallest dimension in the x, y or z axis.

Specific processes according to the invention are presented in the following examples. It should be understood that the examples are given herein for the purposes of illustration and do not limit the invention as has been heretofore described to these particular examples.

EXAMPLES

Articles of tool steel having the composition of about 1.0% carbon, about 0.2% manganese, and 0.3% silicon, the remainder iron are treated according to one embodiment of a process of the subject invention. Sequentially, articles having a minimum dimension as indicated in the Table and which are initially at a temperature of about 70° F. are immersed in a bath of liquid nitrogen at a temperature of about −327° F. The time period for immersion for each article is until the liquid nitrogen stopped boiling or bubbling or until the article has been immersed for about ten minutes, whichever was less. Immediately thereafter, the article is removed from the bath and placed directly in a flow of air sufficient to return the article to the initial temperature of 70° F. in the time period indicated in the following Table.

TABLE

| Article | Min. Dimension (inches) | Time in Bath (minutes) | Time in Air Flow (minutes) | Total Time (minutes) |
|---|---|---|---|---|
| A | 1 | 10 max. | 20 | 30 |
| B | 2 | 10 max. | 30 | 40 |
| C | 3 | 10 max. | 40 | 50 |
| D | 4 | 10 max. | 50 | 60 |

The articles all experience a significant increase in shockability, wearability, stability and/or hardness and, in addition, no cracking or distortion of the articles is noted or observed. As is apparent, the cryogenic treatments for each article are accomplished in relatively short periods of time as compared with conventional cryogenic treatments which can result in significant cost savings in manufacture of the articles.

While there has been shown and described what are considered to be preferred embodiments of the present invention, it will be apparent to those skilled in the art to which the invention pertains that various changes and modifications may be made therein without departing from the invention as defined in the appended claims.

It is claimed:

1. A process for treating an article of metal containing material having a minimum cross-sectional dimension, the process comprising contacting the article at ambient temperature or below with a cryogenic material for a time period up to or equal to about ten minutes, withdrawing the article from contact with the cryogenic material, and immediately subjecting the article to a flow of air sufficient to raise the temperature of the article an average of at least about one degree F. per minute until the article reaches ambient temperature.

2. A process in accordance with claim 1 wherein the temperature of the article is raised at least about five degrees F. per minute on average.

3. A process in accordance with claim 2 wherein the temperature of the article is raised at least about ten degrees F. per minute on average.

4. The process of claim 3 wherein the metal containing material includes steel.

5. The process of claim 1 wherein the cryogenic material includes liquid nitrogen.

6. The process of claim 5 wherein the metal containing material includes steel.

7. The process in accordance with claim 1 wherein the air is ambient air.

8. The process of claim 7 wherein the cryogenic material includes liquid nitrogen.

9. The process of claim 8 wherein the metal containing material includes steel.

10. A process in accordance with claim 1 wherein the flow of air is sufficient to raise the temperature of the article to ambient temperature in a time period equal to or less than a set time period equal to ten minutes plus the minimum cross-sectional dimension in inches multiplied by ten minutes.

11. The process of claim 10 wherein the metal containing material includes steel.

12. The process of claim 11 wherein the cryogenic material includes liquid nitrogen.

13. The process in accordance with claim 10 wherein the air is ambient air.

14. The process of claim 1 wherein the metal containing material includes cemented carbide.

15. A process for treating a tool steel article having a minimum cross-sectional dimension, the process comprising immersing the article at ambient temperature into liquid cryogenic material for a time period up to or equal to about ten minutes, withdrawing the article from contact with the liquid cryogenic material, and immediately subjecting the article to a flow of air sufficient to raise the temperature of the article to ambient temperature in a period of time equal to or less than ten minutes plus ten minutes per minimum cross-sectional dimension in inches.

16. The process of claim 15 wherein the article is a drill bit.

17. The process of claim 15 wherein the cryogenic material includes liquid nitrogen.

18. The process in accordance with claim 15 wherein the air is ambient air.

* * * * *